US005916043A

United States Patent [19]

Saso

[11] Patent Number: 5,916,043

[45] Date of Patent: Jun. 29, 1999

[54] GOLF CLUB

[76] Inventor: Mitsuhiro Saso, 733, Oyama, Kanzaki-cho, Kanzaki-gun, Hyogo 679-24, Japan

[21] Appl. No.: 08/888,831

[22] Filed: Jul. 7, 1997

Related U.S. Application Data

[63] Continuation of application No. 08/479,142, Jun. 7, 1995, Pat. No. 5,645,495, which is a continuation of application No. 08/321,588, Oct. 11, 1994, abandoned, which is a continuation of application No. 07/962,586, Dec. 30, 1992, abandoned.

[51] Int. Cl.[6] ..... A63B 53/04

[52] U.S. Cl. ..... 473/349

[58] Field of Search ..... 473/330, 331, 473/345, 349, 324, 350, 290, 291, 292, 346

[56] References Cited

U.S. PATENT DOCUMENTS

| | | | |
|---|---|---|---|
| 1,525,148 | 2/1925 | Pickop | 473/349 |
| 2,395,837 | 3/1946 | Baymiller | 473/330 |
| 4,211,416 | 7/1980 | Swanson | 473/349 |
| 4,367,878 | 1/1983 | Schmidt | 473/330 |
| 4,521,022 | 6/1985 | Schmidt | 473/330 |
| 4,725,062 | 2/1988 | Kinney | 473/330 |
| 5,098,103 | 3/1992 | MacKeil | 473/330 |
| 5,333,873 | 8/1994 | Burke | 473/330 |
| 5,382,019 | 1/1995 | Sneed | 473/330 |

FOREIGN PATENT DOCUMENTS

| | | | |
|---|---|---|---|
| 266 | 10/1906 | United Kingdom | 273/175 |

*Primary Examiner*—Sebastiano Passaniti
*Attorney, Agent, or Firm*—Smith Patent Office

[57] ABSTRACT

A golf club for improving the flying distance of a ball overcomes toe-down phenomenon due to pulling of the shaft particularly by a skilled player enjoying a high head speed. The golf club further improves the head speed and the directional stability of a hit ball. The golf club has a center of gravity of the head shifted from the toe end of the shaft end by modifying the head shape to decrease the volume of the head by a certain amount at the toe end on the rear side thereof and to increase the head volume at the shaft end on the rear side by an amount equal to the decreased amount. This will reduce the rotational radius of the head about a vertical line, as a rotational center line, when the golf club is suspended at the upper end of the shaft. Furthermore, with a metal wood club, a head is provided with a face which comprises a spherical face formed in such a manner that the curvature in the transverse width direction becomes substantially equal to that in the vertical width direction.

9 Claims, 8 Drawing Sheets the prior art the present invention

GOLF CLUB

This is a continuation of application Ser. No. 08/479,142 filed Jun. 7, 1995, now U.S. Pat. No. 5,645,495, which is a continuation of application Ser. No. 08/321,588, filed on Oct. 11, 1994, now abandoned, which is a continuation of application Ser. No. 07/962,586 filed on Dec. 30, 1992 which was abandoned.

FIELD OF THE INVENTION

The present invention relates to a golf club by which the directional stability and flight distance of a shot ball can be improved.

PRIOR ART

In a conventional wooden club, as well as to a metal wood club, a head is in such a shape that, as shown by two dashed line in FIG. 1, it gradually expands from a shaft side to a toe side. The center of gravity of the head is set at a position inclined toward the toe side rather than the center of the projection plane of the head, thereby the head speed of the golf club may be increased at the time of impacting on the ball.

Also in a conventional golf club of an iron type, according to the similar theory, an end of the back side of a club face part is, when seen from a plane, smoothly connected to the hosel, through a neck part, forming a curve (See dashed line A in FIG. 6) and thus the center of gravity of the club is set at a position slightly inclined toward a toe side.

However, when the center of gravity of the head inclines toward the toe side, as shown by two dashed line in FIG. 2, and when the head B is rotated with holding an end A of the club shaft, a radius R0 of the rotation, with its center line of the rotation positioned at the vertical line made by suspending an upper end of the shaft, increases. Therefore, the metal wood club and the iron club, as shown in FIGS. 3(*a*) and 11(*a*), respectively, are apt to cause covering motion (which means the phenomenon that the toe side goes fast than the shaft side as if the toe side rotates around the shaft side) at each head toe side just before impacting.

For the purpose of inhibiting a hook flying of the shot ball, caused by the covering motion, in the metal wood club, as shown by two dashed line in FIG. 1, a head face surface usually has such a shape that the shaft side expands slightly more forward than the toe side. Accordingly, curvature along the transverse direction of the face surface and curvature along longitudinal direction of the face surface are not the same; usually curvature along longitudinal direction is larger than that along the transverse direction.

On the other hand, as shown in FIG. 10, the covering motion is not the only problem in the iron club; that is, the center of gravity of the iron club slightly inclines toward the toe side in the club face part, therefore for advanced golfers whose down swings are faster than those of beginners, a toe down phenomenon, in which the neck part is twisted downwardly by an accelerated motion applied to the head and thus the toe side of the club face part tends to be lowered, resulting in duff shot.

Accordingly, for the purpose of overcoming the defects of the conventional club head, the inventor, as a result of his sharp research, has converted the basic concept of designing the club head to a new one in order to provide a golf club head by which improvement in the directional stability and flight distance of the shot ball can be realized. That is the object of the present invention.

The present invention has been completed on the inventive concept found by us that due to the property of the sling motion of the club head round the gravity center thereof, in which a heavier part goes forward and a lighter part does not catch up with the heavier part in a manner that the heavier part and the lighter part rotate around the gravity center axis, the conventional club head is subjected not only to the above-mentioned covering movement but also to a pull-back phenomenon in the shaft side as a reaction of the covering movement, accordingly resulting in substantial decrease of the speed of the head. The present invention is, therefore, to provide a golf club which head is formed in such a manner that the amount of a shaft side is increased as much as the amount of a head toe side is decreased so as to shift the center of gravity of the head toward the shaft side and a radius of a rotation, with its center line of the rotation positioned at a vertical line made by suspending an upper end of a shaft, is decreased.

Mere shift of the center of gravity of the head toward the shaft side is not enough to overcome the covering motion of the head; at the same time, the weight balance of the head must be maintained. Therefore, it is advantageous to increase the amount of the shaft side in the head as much as that of the toe side decreases so as to maintain the weight balance of the head. Due to this, the center of gravity of the head usually inclines toward the shaft area by the amount having been shifted.

According to the present invention, as shown by solid line in FIG. 2, since the center of gravity of the head inclines toward the shaft side, when the head is rotated by holding the end of the club shaft, the radius SLAYING of the rotation is smaller than the conventional radius R0 of the rotation. Moreover due to the increased amount of the shaft side, with use of the sling motion in which the heavier part tends to go forward and the lighter part tends to be pulled backward just before impact, as shown in FIG. 3(*b*), it is difficult to cause the covering motion apt to take place in the toe side and the draw phenomenon apt to take place in the shaft side, which results in the improvement in the speed of the head upon giving the impact.

In applying the present invention to a metal wood club, the curvatures along the transverse direction and along the longitudinal direction of the face surface are substantially the same. Since the flight direction of the shot golf ball is dominated by both curvatures along the transverse direction and along the longitudinal direction of the face surface of a point where the impact is given, when the curvatures are not the same, the flight direction is not controlled to a desired direction. In the present invention, however, the covering motion of the head at the time of the impact is inhibited by shifting the center of gravity of the head toward the shaft side, resulting in that the head face surface is formed by a sphere having substantially the same curvatures along both directions of the face surface, which spherical face is most suitable for giving an impact causing the shot ball controlled. Moreover, since it is difficult to cause the covering motion of the head upon giving an impact, the shot ball tends to direct to the extension of the line connecting the center c of spherical body defining the spherical face and the position where the impact was given, by which superior directional stability of the shot ball is ensured.

In applying the present invention to an iron club, it is preferable to form a back side 122 of a club face part 102 by extending the back side 122 until it passes through the center axis (a) of the hosel part 103 (See FIG. 6), and moreover it is preferable to increase thickness A of the back side 122 of a neck part 4 by shifting a part of the weight of the toe side B (See FIG. 8). Due to this, although the design is out of the conventional common knowledge in the light of the conventional toe-heel balance, the center of gravity is located at, or almost at the intersection point of diagonals passing across the club face part, by which good balance is maintained, return of the toe in hitting a ball is suppressed by 70% and the cause for duffing can be solved (See FIG. 11). Therefore secure down strokes can be ensured. Moreover in the light of the design, thickness of a blade can be increased, by which sufficient spinning shot ball can be made.

Further, since the center of gravity is located at, or almost at the intersection point of diagonals passing across the club face part, different from the conventional iron, a toe down phenomenon apt to take place upon giving an impact can be overcome (See FIG. 10) and the weight distribution suitable for the motion going in and out from a heel is completed, resulting in preventation of mistakes caused by duffing.

In the present invention, when the club face part 2 is designed so as to slightly open by about 1.5° against the ball upon addressing, the defect of the conventional club, in which the head easily turns after the impact and therefore golfers are apt to duff (See FIG. 11(*a*)), can be overcome. Namely, an impact is given in a slightly open position and immediately after this, the position becomes square and then the head turns little by little, which makes the shot ball to fly in a high draw trajectory (See FIG. 11(*b*)).

BRIEF DESCRIPTION OF THE DRAWINGS

FIG. 3(*b*) is an explanatory view showing motion of the metal head according to the present invention before and after an impact.

PREFERRED EMBODIMENT

The present invention will now be explained in detail, in which the present invention is applied to a metal wood club.

Figure 1:
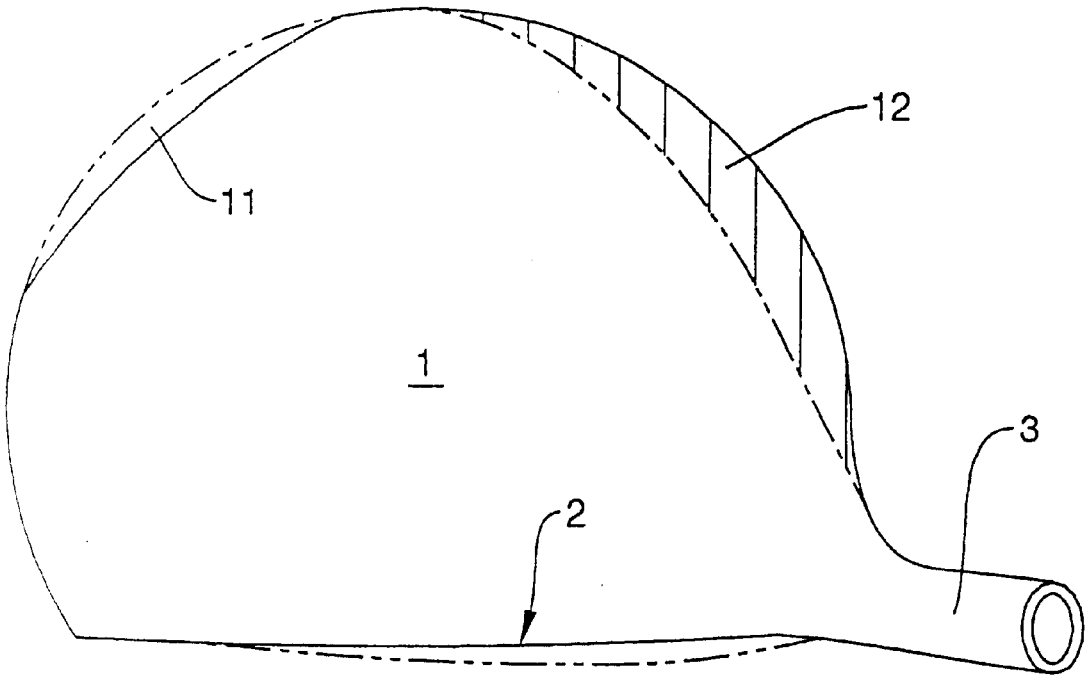
FIG. 1 is a plane view comparing the plane shape of a metal head according to the present invention with that of a conventional metal head.
Figure 2:
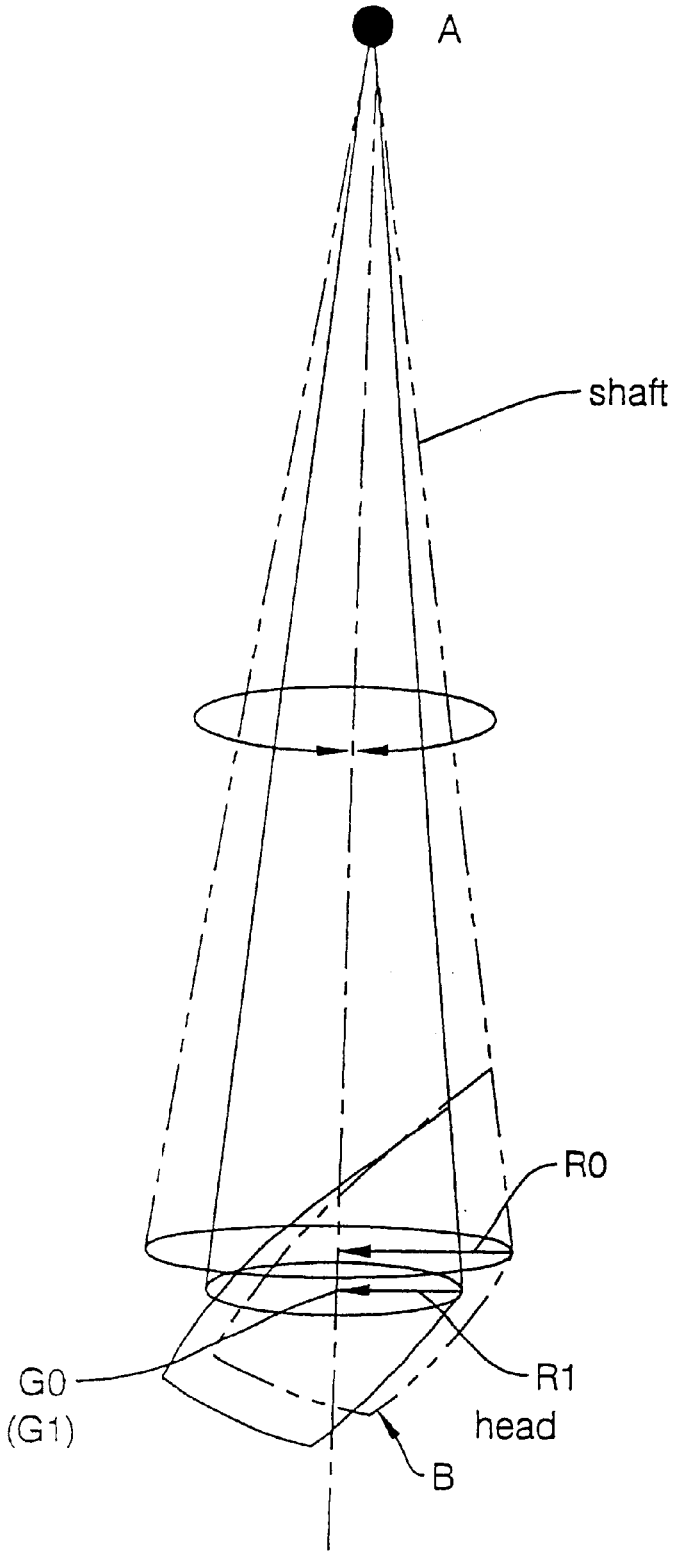
FIG. 2 is a comparative view showing sling motions of wooden clubs with the metal head according to the present invention and with the conventional metal head.
Figure 3A:
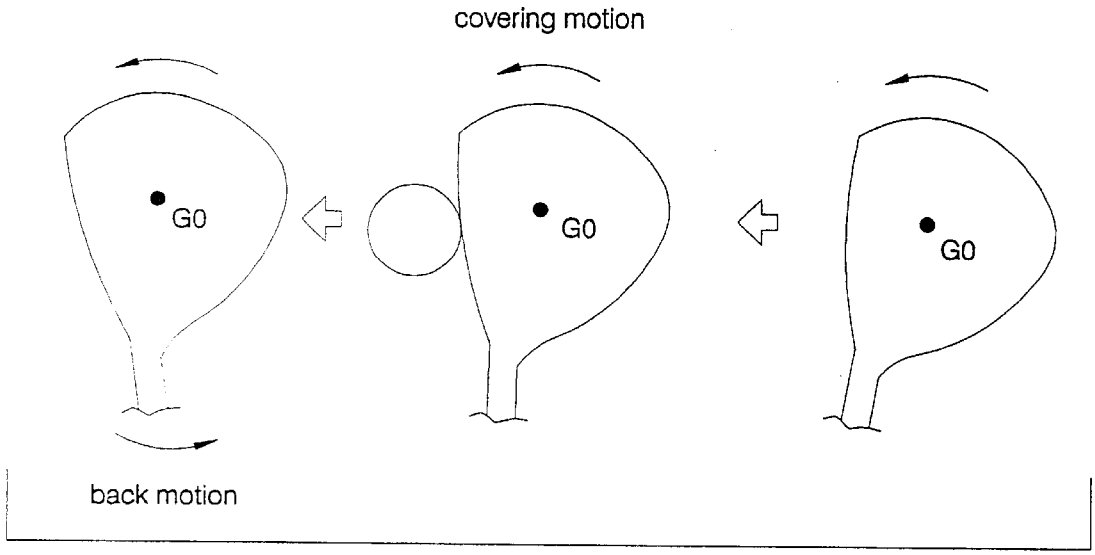
FIG. 3(*a*) is an explanatory view showing motion of the conventional metal head before and after an impact.
Figure 3B:
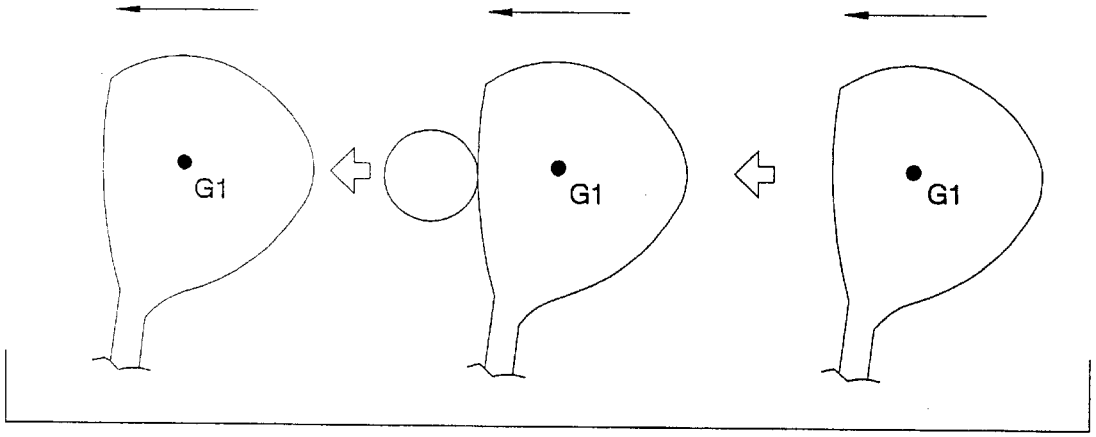

FIG. 1 is a plane view illustrating a projected plane of a metal head according to the present invention, comparing with a conventional metal head. A metal head 1 is a hollow casting, having a spherical face 2 and a hosel part 3 connecting with an unshown shaft. The weight distribution 11 of a toe side is shifted to the back of a shaft side 12 and expanded (See an extent of oblique line). On the whole, the distribution of the amount is not symmetrical, but leans toward the shaft area rather than the toe area. Therefore besides the center of gravity of the head shifts from G0 to the shaft side G1, the distribution of the amount in the shaft side is increased. As a result, the superior weight distribution which, at the moment of giving an impact, suppresses the covering motion in the toe side and the draw phenomenon in the shaft side, can be obtained.

Figure 4:
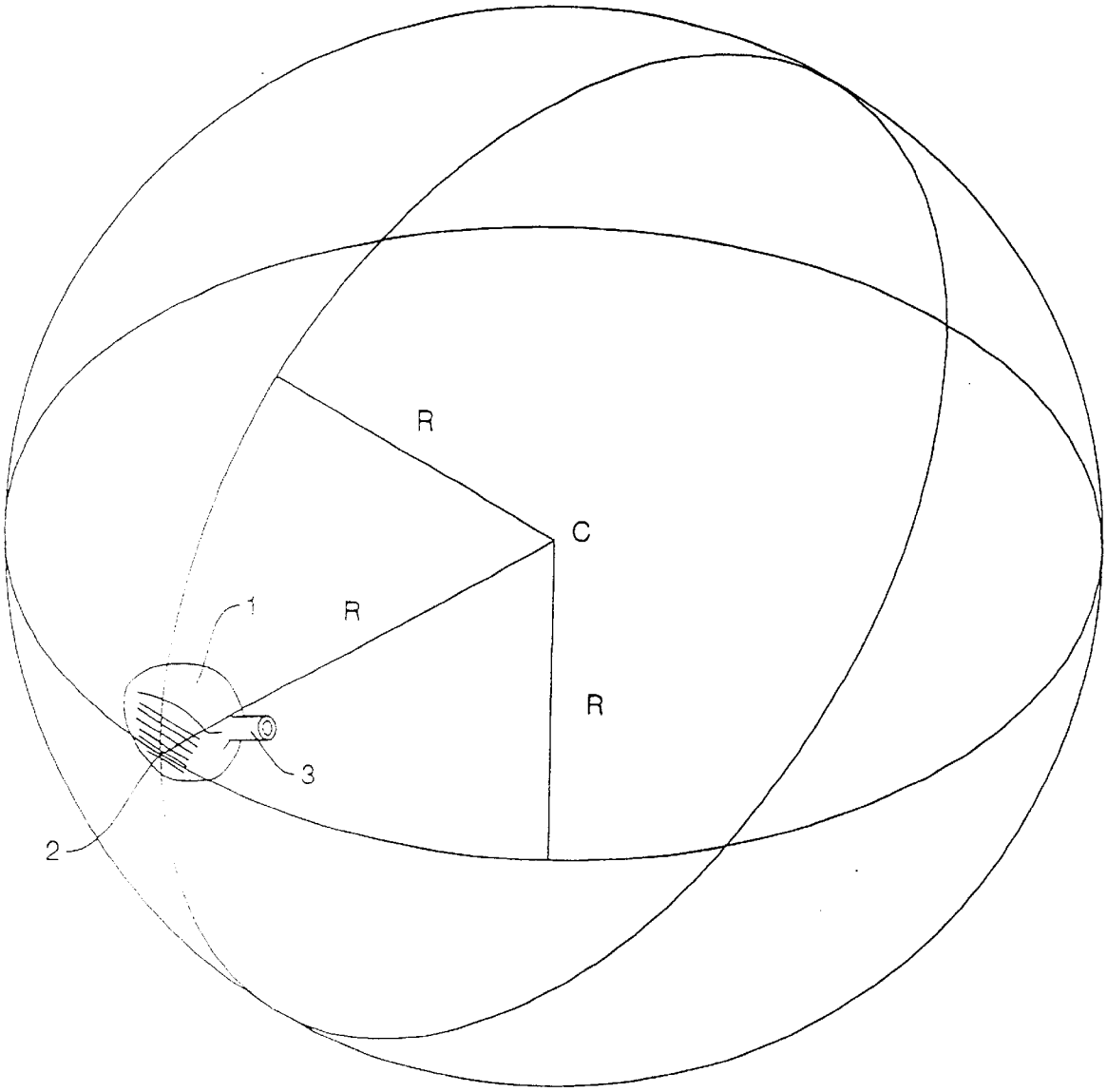
FIG. 4 is a perspective view showing the idea of designing a face surface of the metal head according to the present invention.

As for the face surface 2, as shown in FIG. 4, the curvature R along the transverse direction and the curvature R along the longitudinal direction are unified and the face 2 surface is so designed that it forms a part of a sphere with radius R round a center C as illustrated. The hosel part 103 obliquely protrudes upward from a position adjacent to the face surface translated in parallel to the center of the sphere. The loft angle of the face surface generally falls on the range from about 9°–12° and both curvatures along the transverse and longitudinal directions of the face are selected from the range from 9–12 R so that they are the same. Use of such a golf club makes a golf ball and the face surface collide with each other at the time of impact as if a small ball and a large ball collided with each other and the shot ball is directed to the line extending a radius connecting the spherical center C and the position where the impact was given.

Now the present invention will be explained, in which it is applied to an iron club head.

FIGS. 4 to 7 illustrate an iron golf club according to an example of this invention. A club head 101 is formed by integrally connecting a club face part 102 and a hosel part 103 at a neck part 104. The club head 101 is integrally manufactured with use of an iron material or a copper material by means of forging or casting and polished for finishing.

A fixed hole 130 is formed along the longitudinal direction of the hosel part 103. A shaft 105 is engaged with and fixed to the fixed hole 130 and at the upper side of the shaft, a grip (not shown) is provided.

Figure 5:
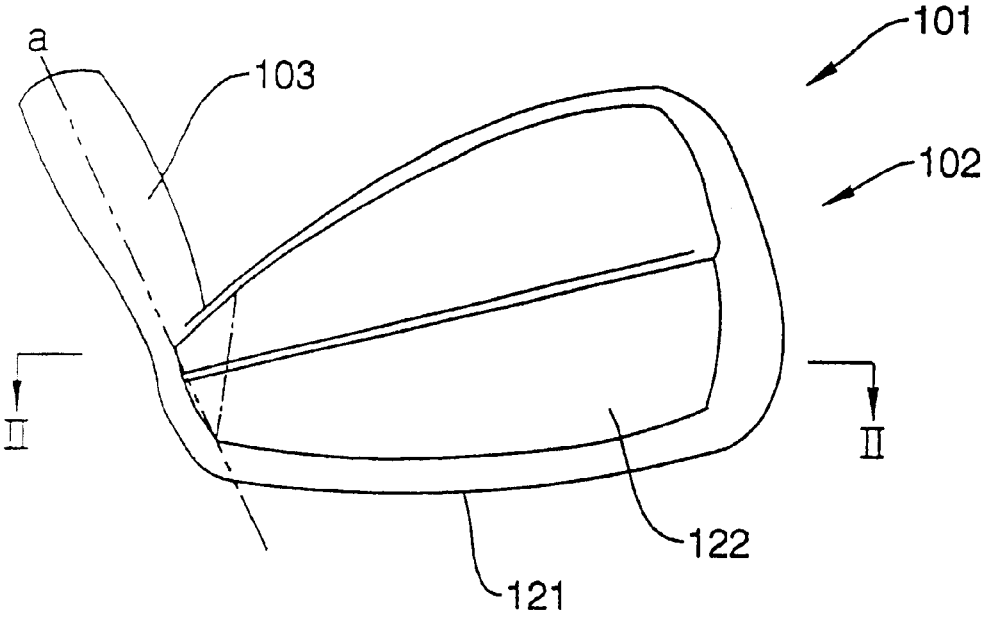
FIG. 5 is a rear view showing a head part of an iron club according to the present invention.
Figure 6:
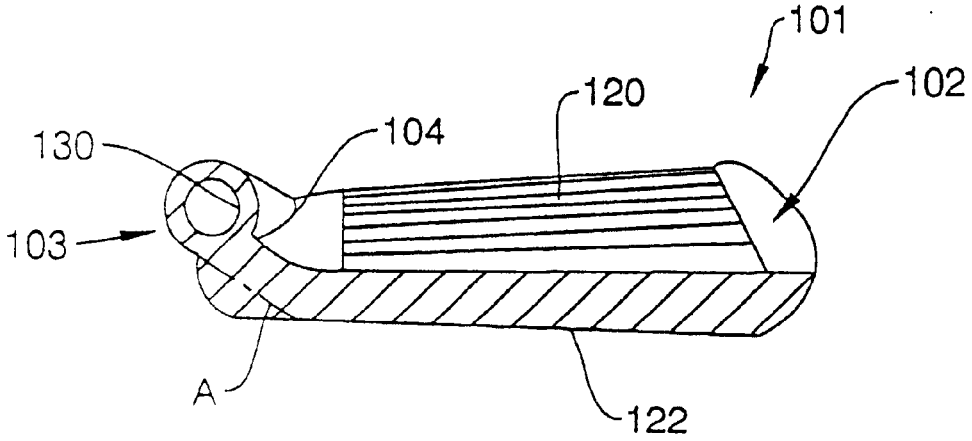
FIG. 6 is a sectional view along—line in FIG. 5.
Figure 7:
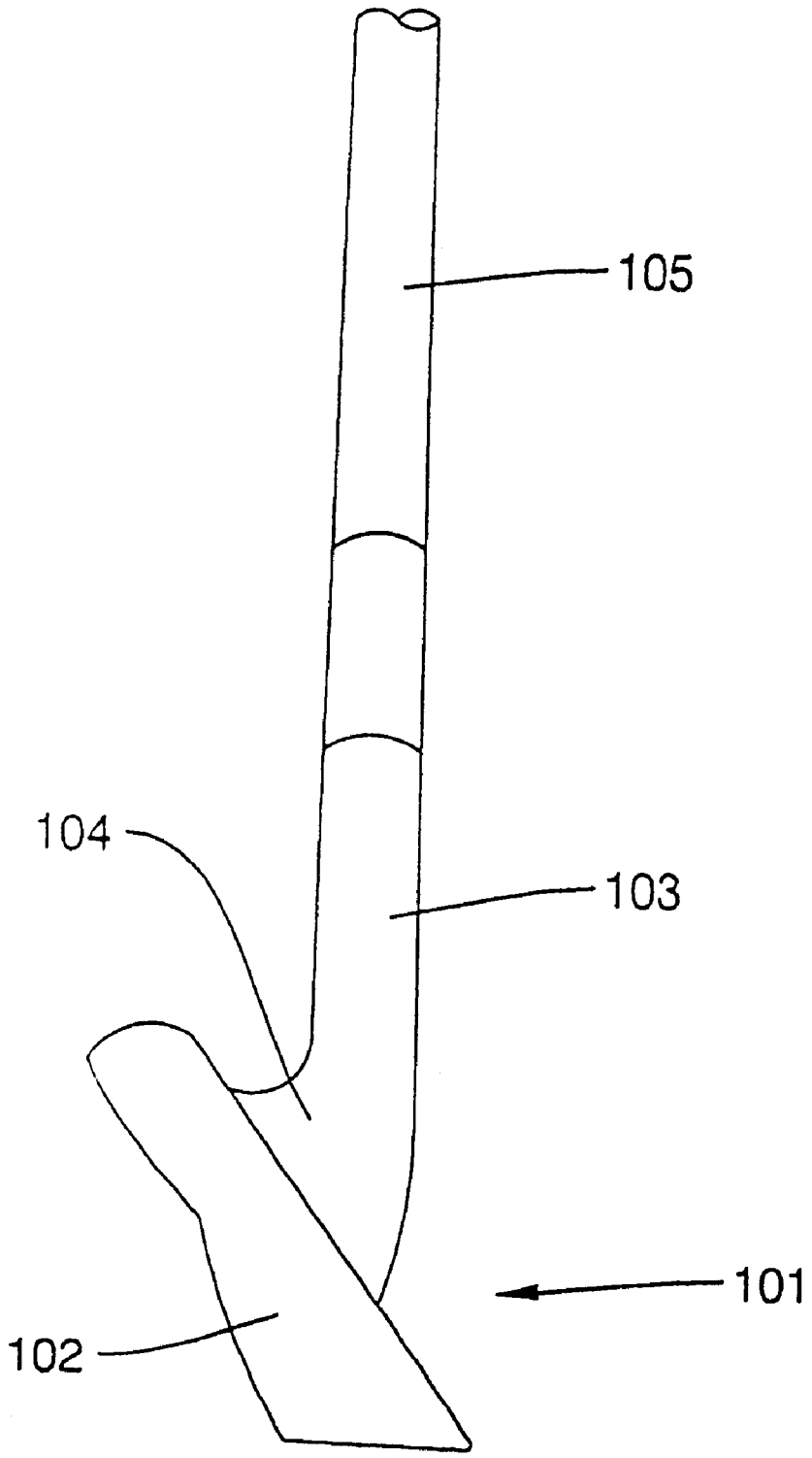
FIG. 7 is a schematical perspective view showing the club according to the present invention.
Figure 8:
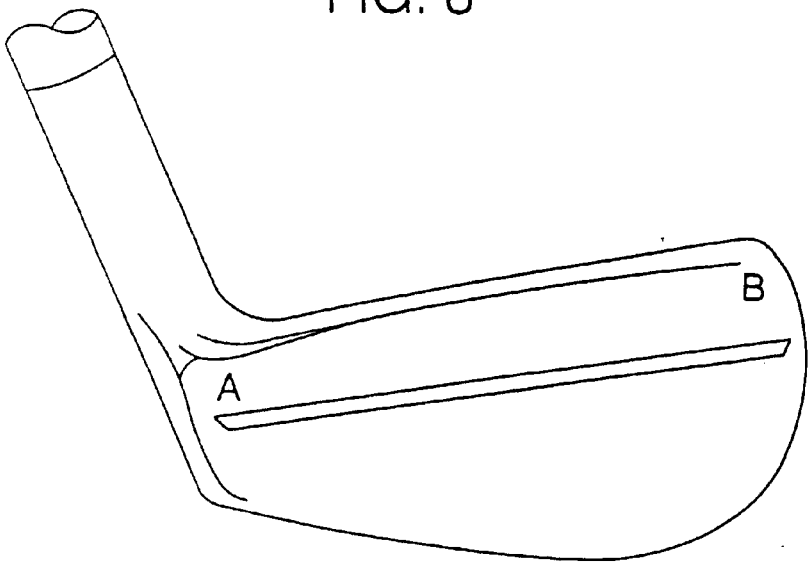
FIG. 8 is a rear view showing an iron club according to another example of the present invention.
Figure 9:
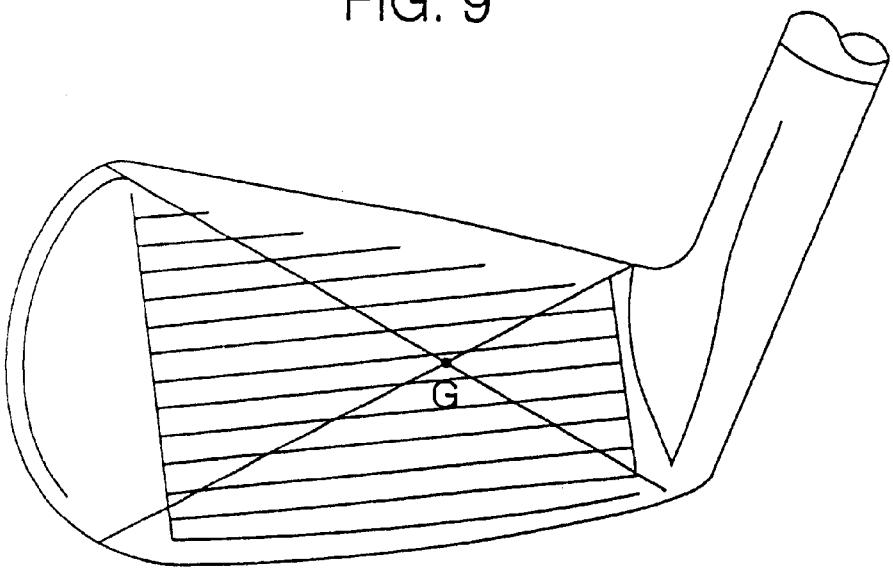
FIG. 9 is a front view showing a position of the center of gravity according to the weight distribution of the present invention.
Figure 10:
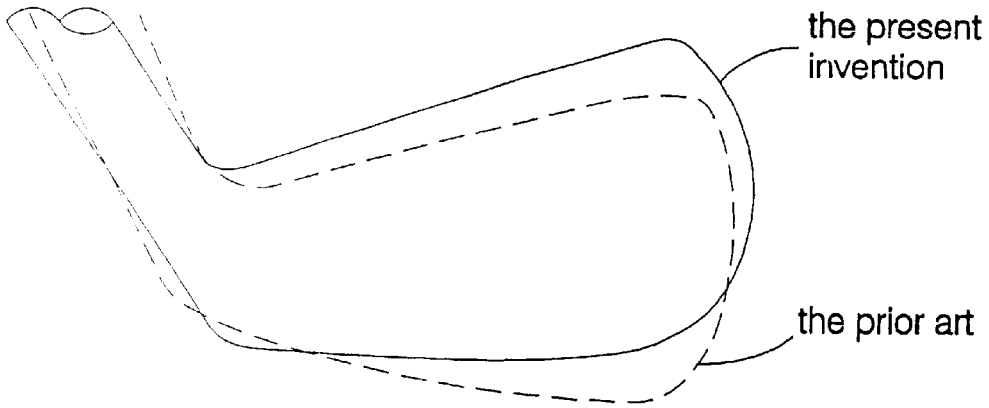
FIG. 10 is a comparative explanatory view showing a toe-down phenomenon in a club according to the present invention (solid line) and in a conventional club.
Figure 11A:
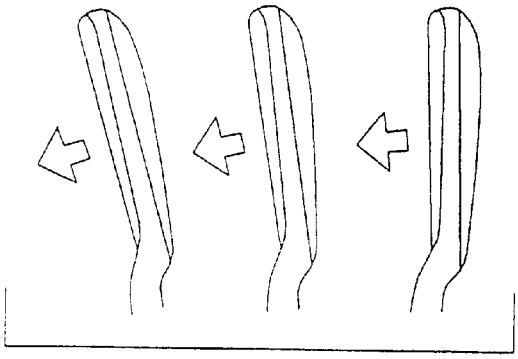
FIG. 11 is a comparative explanatory view showing a covering motion in an iron club according to the present invention (a) and in a conventional club (b).
Figure 11B:
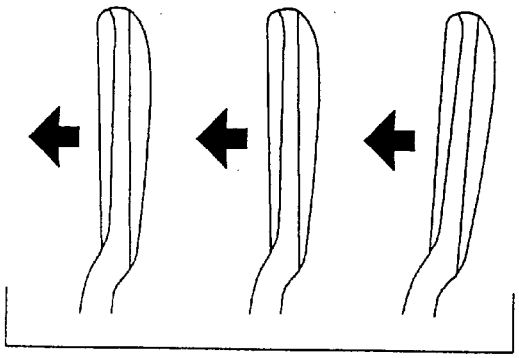

The club face part 102 comprises a face 120 made open by 1.5° from a square, a sole 121 and a back side 122. As shown in FIG. 5, the back side 122 is formed in such a manner that the back side 122 is extended to a position passing through the center axis (a) of the hosel part 103 and connected to the hosel part 103 through an end surface. The thickness of the back side 122 of the club face part 102, therefore, is increased and compared with the shape of a conventional club head, the neck part is made much smaller. As a result, the weight of the neck part is increased and, as shown in FIG. 9, the center of gravity of the club head is located at or adjacent to an intersection point of diagonals of the face part.

Accordingly, when a golfer with this club adresses, even though the club face part 102 is placed in a square position, it looks slightly open. The back side 122 of the club face part 102 is extended to a position passing across the center axis (a) of the hosel part 103. The neck part swells and further the center of gravity of the club face part 102 is positioned at the intersection point of the diagonals and slightly inclines toward a heel side to stabilize the club face part 102. When the club is swung under these conditions, it is easy for a golfer to give an impact to a ball in a square position and fly the ball in a straight direction without a hook or a slice.

Moreover even when advanced golfers swing downward at a high speed, since good rigidity around the hosel part 103 is given and the center of gravity of the club face part 102 is located at the intersection point of the diagonals so as to slightly incline toward the heel side, a toe-down phenomenon hardly takes place and it results in a smooth impact without duffing.

What is claimed is:

1. A golf club comprising:

a shaft having a longitudinal axis; and an iron head having a cylindrical hosel portion formed integrally therewith; said shaft being connected to said iron head at said cylindrical hosel portion, said iron head having a hitting surface, a club head back face and a top face located between the hitting surface and said club head back face, wherein the top face has a substantially constant width and extends from a toe side to behind said cylindrical hosel portion such that said top face extends behind said cylindrical hosel portion to at least a plane passing through the longitudinal axis of said shaft and extending perpendicular to an interface line formed between said top surface and said hitting surface.

2. A golf club as defined in claim 1, wherein said golf club includes metal material down along said club head back face lying in said plane passing through the longitudinal axis of said shaft and extending perpendicular to an interface line formed between said top surface and said hitting surface, whereby said metal material adds weighting located adjacent to said hosel portion.

3. A golf club as defined in claim 1, wherein said top face extends behind said cylindrical hosel portion and beyond said plane passing through the longitudinal axis of said shaft and extending perpendicular to an interface line formed between said top surface and said hitting surface.

4. A golf club as defined in claim 2, wherein said top face extends behind said cylindrical hosel portion and beyond said plane passing through the longitudinal axis of said shaft and extending perpendicular to an interface line formed between said top surface and said hitting surface.

5. A golf club comprising:

a shaft having a longitudinal axis; an iron head having a cylindrical hosel portion formed integrally therewith; said shaft being connected to said iron head at said cylindrical hosel portion, said iron head having a hitting surface, a club head back face and a top face located between the hitting surface and the club head back face, wherein the top face has a substantially constant width and said hitting surface includes a toe side strike face edge and a heel side strike face edge together defining a primary hitting area, said iron head further includes a bottom club surface located between said hitting surface and said club head back face, said iron head further including a geometric surface defined by both said heel side strike face and points extending from said heel side strike face perpendicular to said hitting surface toward said club head back face, wherein a point of intersection between said longitudinal axis of said shaft and the geometric surface is located such that the point of intersection is on or within said iron head.

6. A golf club as defined in claim 5, wherein said toe side strike face and said heel side strike face are parallel.

7. A golf club as defined in claim 5, wherein said golf club includes metal material along said club head back face lying in a plane, said plane passing through the longitudinal axis of said shaft and extending perpendicular to an interface line formed between said top surface and said hitting surface, whereby said metal material adds weighting located adjacent to said hosel portion.

8. A golf club as defined in claim 5, wherein said top face extends from a toe side to behind said cylindrical hosel portion to at least a plane passing through the longitudinal axis of said shaft and extending perpendicular to an interface line formed between said top surface and said hitting surface.

9. A golf club as defined in claim 8, wherein said top face extends behind said cylindrical hosel portion and beyond said plane passing through the longitudinal axis of said shaft and extending perpendicular to an interface line formed between said top surface and said hitting surface.

* * * * *